United States Patent [19]

Finsterwalder

[11] 4,185,440

[45] Jan. 29, 1980

[54] METHOD OF AND PARTS USED IN THE CONSTRUCTION OF A PRESTRESSED CONCRETE STRUCTURE

[75] Inventor: Ulrich Finsterwalder, Münich, Fed. Rep. of Germany

[73] Assignee: Dyckerhoff & Widmann Aktiengesellschaft, Münich, Fed. Rep. of Germany

[21] Appl. No.: 897,122

[22] Filed: Apr. 17, 1978

[30] Foreign Application Priority Data

Apr. 22, 1977 [DE] Fed. Rep. of Germany ..... 2717869

[51] Int. Cl.[2] ..... E04B 1/06

[52] U.S. Cl. ..... 52/741; 264/33; 264/34; 264/228; 52/223 R; 29/423; 29/452; 29/469

[58] Field of Search ..... 52/223 R, 223 L, 227–230, 52/737,726, 262, 263, 741; 264/228; 29/452, 423, 469

[56] References Cited

U.S. PATENT DOCUMENTS 3,022,713 2/1962 Friberg ..... 52/230

3,167,882 2/1965 Abbott ..... 52/230

3,561,185 2/1971 Finsterwalder et al. ..... 52/737

FOREIGN PATENT DOCUMENTS 113494 12/1966 Netherlands ..... 52/223 R

*Primary Examiner*—James L. Ridgill, Jr.

*Attorney, Agent, or Firm*—Toren, McGeady and Stanger

[57] ABSTRACT

In the construction of a prestressed concrete structure, such as a bridge girder, forms for at least a part of the structure are built and a thin-walled sheathing tube is placed within the forms. Axially displaceable stiffener tubes extend through the sheathing tube. After the concrete is poured into the forms around the sheathing tube and sets, a steel bar is pushed through the sheathing tube and displaces the stiffener tubes. The steel bar can be left in the sheathing tube as the tendon or replaced with a tendon. Subsequently, the tendon is tensioned. Spacers encircling the steel bar keep it centered as it is pushed through the sheathing tube. Preferably, the stiffener tubes consist of an inner tube and an outer tube and each is made up of a plurality of short axially extending lengths with the joints of the inner tube staggered relative to the joints of the outer tube.

15 Claims, 8 Drawing Figures

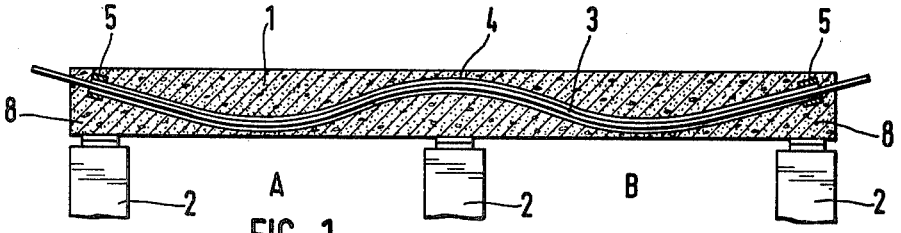
FIG. 1
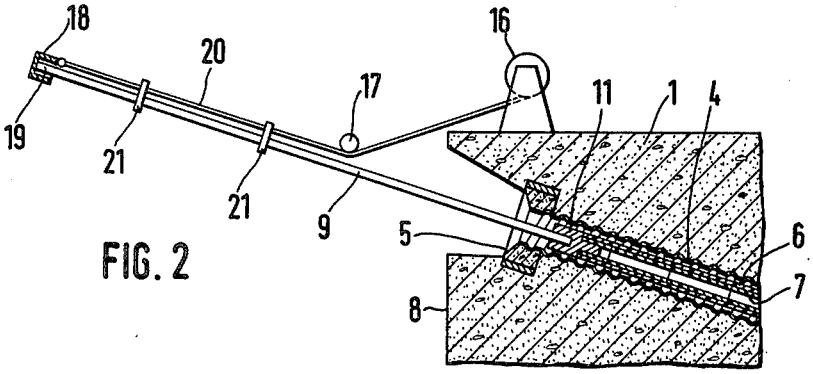
FIG. 2
FIG. 3
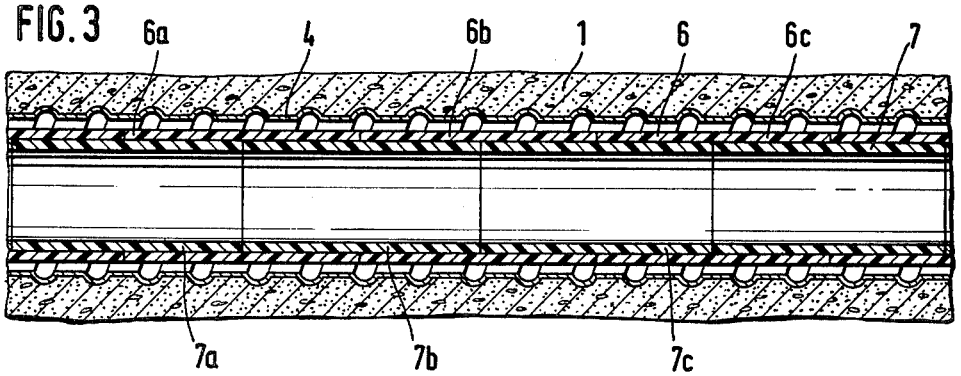
FIG. 4
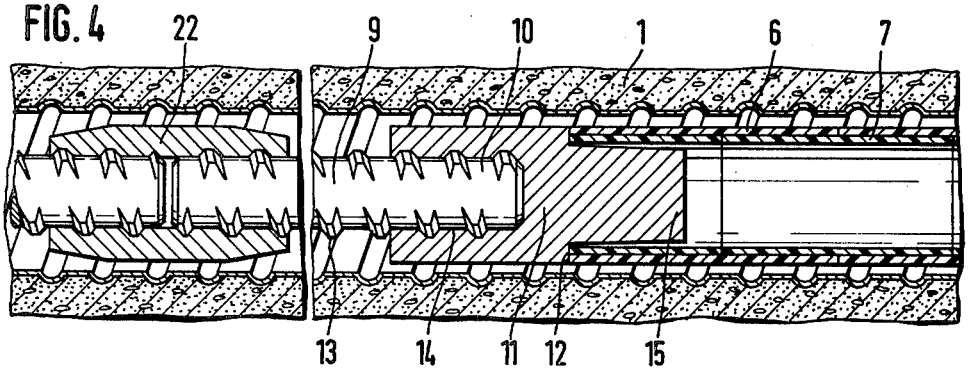

METHOD OF AND PARTS USED IN THE CONSTRUCTION OF A PRESTRESSED CONCRETE STRUCTURE

SUMMARY OF THE INVENTION

The present invention is directed to a method of and parts for the construction of a prestressed concrete structure and, more particularly, it concerns the arrangement of thin-walled sheathing tubes incorporated into the concrete with tendons inserted into the sheating tubes after the concrete has set.

Apart from prestressed concrete with immediate bonding, where the tendons, such as prestressing wires, are directly encased in the concrete in the tensioned state, prestressed concrete structures are known which involve a subsequent bonding of the tendons. In such structures, the tendons must be longitudinally movable after the concrete has set so that they can be tensioned. Accordingly, the tendons are enclosed withing sheathing tubes. To afford a bond between the conrete and the tendons within the sheathing tubes encased in the concrete, cement grout is subsequently introduced into the hollow space between the tendons and the sheathing tubes.

Usually the tendons are introduced along with appropriate sheathing tubes into the framework as a unit before the concrete is poured. This arrangement is disadvantageous because the tendons are very heavy and, when they are thick, have a high stiffness characteristic. As a result, the placement of the tendons and the sheathing tubes in the formwork as well as providing the requisite alignment in the structure is very time-consuming and involves significant labor costs. Furthermore, additional steel structures are often required to absorb the weight and the component forces in curved tendons both before and during the placement of the concrete. Moreover, sheathing tubes are frequently damaged when they are placed into the framework or when the concrete is poured and vibrated, with the resultant danger that a portion of the concrete as poured will penetrate into the sheathing tubes and harden, making it difficult to tension the tendons.

It is also known to form ducts in the concrete structures by using sheathing tubes and then subsequently inserting the tendons into these ducts. Since the sheathing tubes have only a small wall thickness and, therefore, have practically no natural stiffness, they are stiffened with matrix bars during placement in the formwork and pouring of the concrete and these matrix bars are later pulled out of the ducts before the tendons are inserted, note DT-PS No. 1,134,407. When the sheathing tubes are stiffened by means of matrix bars they have basically the same problems as if the tendons themselves were inserted into the sheathing tubes from the outset. Moreover, in the case of longer partial sections, it is difficult to remove the relatively rigid matrix bars from the sheathing tubes.

Accordingly, there has been an increased tendency to employ sheathing tubes with a higher stiffness factor instead of using stiffeners. Such a procedure, however, does not afford reliable protection against damage of the sheathing tubes during placement of the sheathing tubes or of the concrete. Damage could result from bulging. In addition, such a procedure does not ensure the imperviousness of the sheathing tubes, it would be possible for concrete to find its way into such tubes. The sheathing tubes may be dented at the points of support, further, the sheathing tubes bend between the points of support, since they have a low bending resistance. Additionally, there is the danger that the tubes will be damaged during vibrating of the concrete.

Therefore, it is a primary object of the present invention to afford an improved method for constructing prestressed concrete structures where the tendons are introduced into ducts formed in the concrete.

In accordance with the present invention, the sheathing tubes are stiffened during placement into the formwork by means of smooth-walled plastic tubes or the like extending axially through the sheathing tubes so that there is little play between them. The plastic tubes are retained in the sheathing tubes while the concrete is placed and set and then they are axially displaced out of the sheathing tubes by pushing a steel bar through the sheathing tubes. The steel bar can act as the tendon or, after displacement of the stiffener tubes, can be be replaced by the tendon. Advantageously, the stiffening of a sheathing tube is provided by two telescoped tubes, one within the other, with little play between the stiffening tubes and the sheathing tube. Moreover, the stiffening tubes are formed of relatively short axially extending pieces with the joints of the inner tube being staggered relative to the joints of the outer tube forming the stiffening tubes. The steel bar used for axial displacement of the stiffening tubes can advantageously remain in the sheathing tube as the tendon or as a part of it.

The weight of a sheathing tube having a diameter of 55 mm and used with a prestressing tendon having a diameter of 32 mm and stiffened with plastic tubes in accordance with the invention, corresponds to the weight of a steel bar having a diameter of approximately 10 mm. Its stiffness corresponds to the stiffness of a steel bar having a diameter of approximately 14 mm. As a result, such a sheathing tube can easily be laid along a predetermined elastic line within the formwork together with the untensioned reinforcing bars. After the concrete for the structure has set, the plastic stiffening tube or tubes can be pushed out by a steel bar pushed or forced through the sheathing tube. Advantageously, the steel bar can be used as the tendon which is to be subsequently tensioned. The steel bar can be pushed through the sheathing tube by means of a light electric winch mounted on the structure containing the sheathing tube.

Since smooth-walled plastic tubes are used for the stiffening action, such tubes can be easily displaced even if concrete grout has penetrated the interior of the sheathing tube, because no bond develops between the grout and the smooth plastic tube. Dividing the stiffening tubes into short axial lengths of plastic tube of about 60 cm, facilitates the removal of the stiffening tubes even when small working spaces are involved and also facilitates their reuse. By staggering the locations of the tube joints, a bending resistant tube can be provided which can be placed along a curved path. Therefore, after the concrete has set, the significantly stiffer steel bar, which rests against a wall of the sheathing duct and affords the subsequent prestressing action, can be inserted with a force which can be calculated.

It is surprising to note that it is possible to insert thick steel bars having diameters of 32 to 36 mm into sheathing tubes having several bends by means of relatively light forces. It is only necessary that a certain ratio of the diameter of the steel bars and of the sheathing tubes be adhered to. This ratio is approximately 1:1.2 to 1:5, depending on the stiffness determined by the diameter of the steel bar.

Furthermore, the invention results in significant economical advantages, as an example, the time required for construction can be reduced, since operations for placement of the tendons before the concrete is placed, can be reduced and simplified. Labor costs can be cut, since the insertion of the steel bars after the concrete has set, is performed by machine. The removal of the stiffening tubes is, so to speak, a side product of the method of inserting the tendons.

It is preferable if the steel bars are centered with respect to the sheathing tubes by means of plastic spacers or the like, thus, when the bars being inserted are very long, the friction force can be reduced, since the spacers serve as sleeve bearings at the same time.

When the tendons are very long, it is advantageous if the steel bars are shorter than the total length of each tendon and adjacent bars are joined together by sleeves. It is preferred if these sleeves are constructed of a material having a higher strength than the steel bars. The higher strength of the sleeve material facilitates a smaller diameter of the sleeves and, in turn, the smaller diameter of the sleeves permits a smaller diameter of the sheathing tubes. Furthermore, it is apparent that when the bars are joined together by sleeves, the bars have a higher vibration strength than in the case where the bars are joined by sleeves made of a softer material.

It is also advantageous if the steel bars used as tendons have a threaded surface. Ribs can be formed on the steel bars by a hot rolling action and the ribs can provide a partial thread. Due to the use of threaded bars, sleeve joints can be made especially easily and simply and the spacers can be securely fixed at any chosen location along the bar.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 1 is a diagrammatic longitudinal section of a prestressed concrete structure in the form of a girder spanning a series of supports with one tendon extending through the girder;

FIG. 2 is an enlarged view of a portion of the structure in FIG. 1 with a sheathing tube encased in the concrete and stiffened by plastic tubes;

FIG. 3 is an enlarged view of the sheathing tube with a steel bar axially displacing the plastic tubes;

FIG. 4 is an enlarged longitudinal sectional view of part of a prestressed concrete girder illustrating a steel bar being pushed through the stiffening tube;

DETAILED DESCRIPTION OF THE INVENTION

Figure 5:
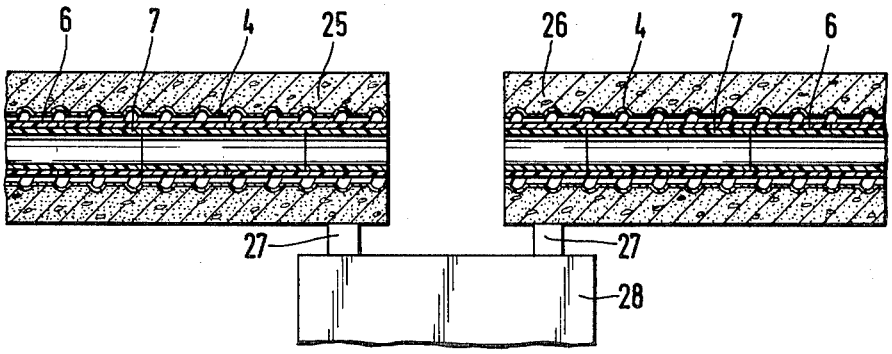
FIGS. 5–7 illustrate diagrammatically the various stages in the construction of a prestressed concrete structure in accordance with the present invention, that is, the connection of two single span girders over a support, to form a continuous girder.

To explain the concept of the present invention, FIG. 1 is a longitudinal sectional view of a reinforced concrete girder 1, for example, a bridge girder which extends over three vertically extending supports or piers 2, forming two adjacent spans A, B. In accordance with the pattern of the bending moment in the girder due to its dead weight, tendons 3 are positioned in the girder. Only one tendon is shown in the form of a continuous strand. The tendons 3 are each placed in a sheathing tube 4 and are secured in the opposite ends 8 of the girder 1 by anchors 5.

In FIGS. 2–4, the method of placing the tendons is shown in more detail. Though not shown in the drawing, the formwork for at least a part of the structure is provided, and reinforcement is placed into the formwork along with sheathing tubes 4. In FIG. 2, a longitudinal sectional view of the sheathing tube 4 encased in concrete is provided. The sheathing tube 4 consists of a light, spirally wound sheet metal tube which is stiffened for placement within the formwork. The stiffening of the sheathing tube is provided by a pair of tubes 6 and 7, one located within the other, that is tube 7 is telescoped into tube 6. Each of the stiffening tubes 6, 7 consists of a number of relatively short axially extending pieces 6*a*, 6*b*, 6*c* and 7*a*, 7*b*, 7*c* each approximately 60 cm in length and with the joints of the inner pipe 7 staggered axially relative to those of the outer pipe 6. In this arrangement, the stiffness of a single continuous tube is achieved with the advantage that the stiffener tubes can be inserted and removed even in a narrow working space. Another advantage of the use of short pieces is that any damaged pieces can be easily replaced.

Concrete is poured into the framework after all the sheathing tubes 4 and the untensioned reinforcing bars are placed. After the concrete has set for a desired period of time, a steel bar 9 is inserted at one end surface 8 of the structure 1, note FIG. 4. A pusher 11 is mounted on the front end 10 of the steel bar. The pusher is shaped to provide an annular shoulder 12 which rests against the adjacent ends of the first sections of the inner and outer tubes 6,7, note FIG. 3. Pusher 11 has a threaded blind bore 14 into which the threaded leading end of the steel bar 9 is screwed. Further, the exterior surface of the steel bar 9 has ribs 13 which extend along a helical path. If a smooth bar is used, the thread can be rolled on or cut into the front end 10 of the bar or a threaded bolt can be welded onto the bar. Moreover, pusher 11 includes a tapered plug 15 projecting axially from the shoulder 12 into the interior of the inner tube 7. The steel bar 9 including the pusher 11 can be forced into the duct formed by the sheathing tube 4 by means of an electric winch 16, note FIG. 4. Winch 16 is mounted on the structure 1 and a pull rope or cable 20 extends from the winch around a roller 17 and is secured at its end to the outer end 19 of the steel bar by means of a head 18. The cable 20 is held along the steel bar by means of clips 21. By reeling in the cable 20, the steel bar 9 is forced into the sheathing tube 4. The pusher 11 axially displaces the short lengths of the stiffener tubes 6 and 7 out of the opposite end of the sheathing tube duct.

As a rule, the axial length of the structure is greater than the length of an individual steel bar 9. Accordingly, it is advantageous if the overall length of the steel bar 9 is formed of individual sections joined together by sleeves 22, note FIG. 3. Preferably, the sleeves 22 are formed of a material having a higher strength than the material of the steel bars. As a result, the diameter of the sheathing tube through which the sleeves 22 pass can be kept as small as possible.

It is especially advantageous if the steel bars 9, used to axially displace the stiffener tubes, also form the tendons for the structure, that is, they remain in the sheathing tube 4 after displacing the stiffening tubes. During the insertion of the steel bars 9, the sheathing tube 4 is stiffened by the surrounding concrete. Therefore, by following the alignment of the sheathing tube enclosed in concrete, even relatively thick steel bars can be brought into the intended predetermined shape without difficulties and with a force which can be calculated. Therefore, the time-consuming prebending of the prestressing bars is eliminated.

To facilitate the insertion of the steel bar, spacers, preferably of plastic, encircle the steel bar and center it with respect to the sheathing tube 4, preventing buckling of the bar 9 and also reducing the friction at the inside wall of the sheathing tube.

Figure 6:
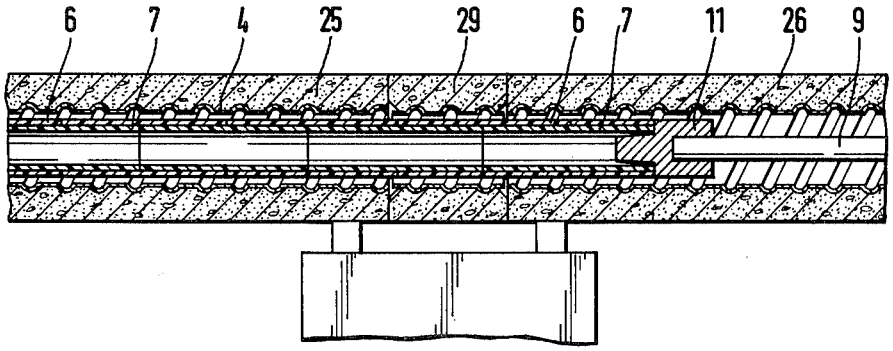
Figure 7:
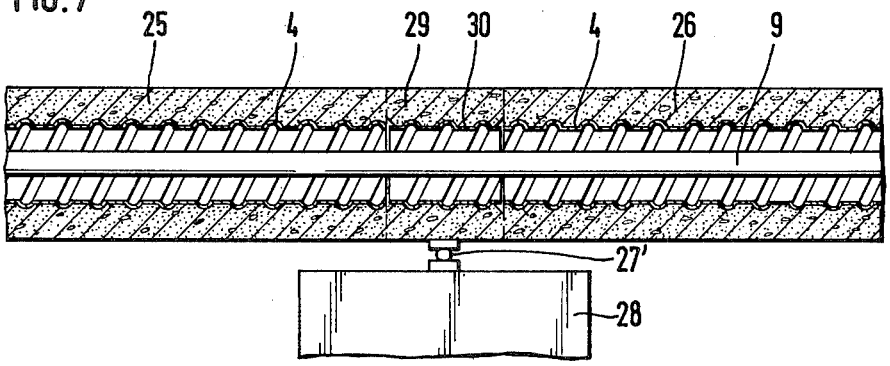

An especially advantageous use of the method embodying the present invention results in the production of a multiple-span bridge structure made of several single-span girders. The single-span girders are connected over a support and form a continuous girder by pouring an intermediate section of concrete at the support. In such a structure, it is necessary to provide prestressing in the region over the support to achieve the desired continuous effect. FIGS. 5–7 show how the method is accomplished in accordance with the present invention. Initially, two separately constructed single-span girders 25, 26 are supported on provisional bearings 27 on a support pier 28. The adjacent ends of the girders 25,26 are spaced apart. Sheathing tubes 4 within the separate girders are encased in concrete as described above. Similarly, the sheathing tubes 4 are stiffened by the plastic outer and inner tubes 6,7. Care must be taken in constructing the girders 25,26 that the axes of the sheathing tubes in the girders are at least in approximate alignment.

Subsequently, using a steel bar 9 with a pusher 11 mounted on its leading end, the stiffening tubes 6,7 are displaced from one of the girders, in the illustrated example of the girder 26, into the intermediate space between the adjacent ends of the girders 25,26 and into the duct formed by the sheathing tube 4 in the other girder 25. As the steel bar continues its movement, the stiffening tubes 6,7 are also pushed out of the girder 25. The intermediate space between the adjacent ends of the girders 25,26 is bridged by tubes 6,7 pushed out of the girder 26.

With stiffening tubes 6,7 extending between the adjacent ends of the girders 25,26, an appropriate formwork is constructed around this intermediate space. Concrete is poured into the formwork filling the space between the adjacent ends of the girders, however, no bond develops between the concrete 29 deposited between the ends of the girders and the smooth plastic outer tube 6. Accordingly, after the concrete has set, the stiffening tubes 6,7 can be completely displaced out of the girder 25, while the steel bar 9 remains in the duct formed by the sheathing tube 4 as prestressing reinforcement. In the region of the girders 25,26, the duct for the tendon is formed by the sheathing tubes 4 while in the intermediate concrete 29 between the ends of the ducts only a duct 30 is formed. By prestressing the steel bar 9 complete continuity can be provided between the girders 25, 26 over the top of the pier 28. Steel bar 9 in FIGS. 6 and 7 is merely representative of additional steel bars or tendons provided through the girders. With the girders 25,26 connected to one another, the combined structure is supported by a final bearing 27' on the pier 28, note FIG. 7.

Figure 8:
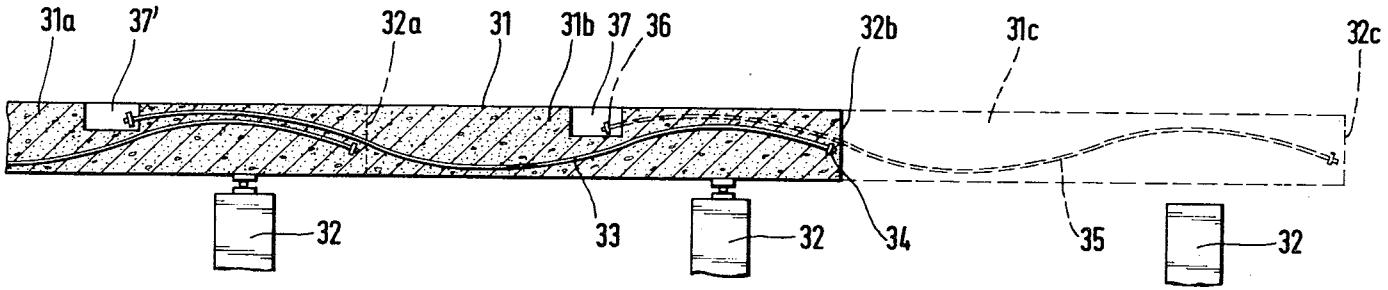
FIG. 8 illustrates another example of the present invention showing the method of constructing a multiple span bridge structure from cantilevered sections.

Another example of the method embodying the present invention is shown in FIG. 8. Multiple-span bridge structures are frequently constructed by cantilevering individual span sections, by means of slidable scaffolding, from vertical supports or piers. This scaffolding spans approximately the length of one span between supports and is moved successively after each section of the superstructure is constructed. For reasons of statics, the construction joints between bridge sections are arranged at approximately the quarter points of the lengths of a span, since the bending moments are lowest at these quarter points.

As described above, the tendons for bridge spans of this kind are generally tensioned at the construction joint and are extended beyond the construction joint by means of a coupling. This coupling has proven to be a weak point in the structure. This weakness occurs because any kind of coupling subject to a time-dependent plastic extension after a tendon has been tensioned and the bond between the tendon and the concrete of the structure has been established. As a result, cracks occur in the concrete at the coupling point, instead of developing the prestressing required at this particular location. Such cracks are dangerous, since the bending tension forces resulting from live loads are fully shifted to the tendons, instead of being absorbed by variations in the compressive stresses in the prestressed concrete. An additional advantage is the reduction in the vibration strength of the tendon at the coupling point. Accordingly, the useful life of the structure is reduced.

By using the method of the present invention it is possible to eliminate such a coupling point at the construction joint in such bridge structures. In FIG. 8, a bridge structure 31 is supported on a number of spaced vertically extending piers 32. The superstructure is constructed as individual, horizontally extending sections **31*a*, 31*b* and 31*c*, each of which is terminated by a vertical construction joint 32*a*, 32*b* and 32*c* which abuts the next section. As illustrated in FIG. 8, section 31*b* has just been completed and the next section 31*c*** is under construction.

The tendons required for prestressing the bridge superstructure 31 located in the section **31*b* extend, corresponding to the bending moments, through the lower portion of the span intermediate the piers 32 and through the upper portion of the span in the region over the piers. The tendons 33 are anchored at the construction joint 32*b* in anchors 34. Further, sheathing tubes containing stiffening plastic tubes are provided in the section 31*b* in the region over the piers, and extending toward the section 31*a*. Further, these sheathing tubes continue into the segment 31*c* which is being constructed. The arrangement of these sheathing tubes is shown by dotted line 35. When the section 31*c* is completed, tendons are inserted into the sheathing tubes from the construction joint 32*c*. During this insertion operation, the stiffening plastic tubes within the sheathing tube in the form of the short axial lengths, are displaced and removed from the opposite end of the sheathing tubes at a niche 37. After the tendons are inserted along the path 35, they are tensioned at the anchor 36 within the niche 37 for providing the requisite tensioning force. Subsequently, the niche 37** can be filled with concrete after the tendons have been tensioned.

By arranging the ducts within the sheathing tubes for prestressing of the tendons, it is possible to arrange the tendons over adjacent spans in an overlapping arrangement above the piers 32 so that coupling of the tendons at the construction joints is avoided.

While specific embodiments of the invention have been shown and described in detail to illustrate the application of the inventive principles, it will be understood that the invention may be embodied otherwise without departing from such principles.

What is claimed is:

1. Method of constructing a longitudinally extending structure of prestressed concrete comprising building formwork for at least a longitudinally extending portion of the structure, placing at least one thin-walled sheathing tube into the formwork extending in the longitudinal direction for forming a duct extending therethrough, pouring concrete into the formwork and incorporating a sheathing tube therein, inserting a tendon into the duct formed by the sheathing tube after the concrete has set for a desired period and tensioning the tendon, wherein the improvement comprises stiffening the sheathing tube before pouring the concrete by inserting smooth-walled tubes of plastic or the like through the sheathing tube for the length thereof to be incorporated into the concrete and fitting the smooth-walled tubes within the sheathing tube with little play therebetween, retaining the smooth-walled tubes within the sheathing tube during the placing and setting of the concrete, and axially displacing the smooth-walled tubes out of the sheathing tube so that the tendon can be inserted therein and subsequently tensioned.

2. Method, as set forth in claim 1, including forming the structure as a series arrangement of longitudinally and horizontally extending members each supported on at least one vertically arranged support, forming each member with construction joints extending transversely of the longitudinally extending series direction and with the construction joints spaced in the series direction from the vertically arranged support on which the member is supported, extending the tendon at least partially through two adjacent members and locating one end of the tendon within one member intermediate the construction joint ends of the one member and locating the other end of the tendon in the other member adjacent the construction joint end thereof remote from one member.

3. Method, as set forth in claim 2, including locating the one end of the tendon spaced from the support of the one member in which it is located, and providing a niche in the upper surface of the member containing the one end of the tendon.

4. Method, as set forth in claim 1, including using telescoping smooth-walled tubes one fitting into the other for stiffening the sheathing tube.

5. Method, as set forth in claim 4, including using short axial lengths of the telescoping smooth-walled tubes and axially displacing the joints of the inner tube lengths relative to the joints of the outer tube lengths.

6. Method, as set forth in claim 4, including using telescoping smooth-walled tubes having axial lengths of approximately 60 cm.

7. Method, as set forth in claim 1, including axially displacing the smooth-walled tubes by pushing the tendon from one end to the other through the sheathing tube and using the tendon for pushing the smooth-walled tubes ahead of the tendon out of the sheathing tube.

8. Method, as set forth in claim 7, including constructing a pair of single-span girders in series alignment and separately supporting the adjacent ends of the girders on a support member and spacing the adjacent ends apart in the direction of series alignment and with the sheathing tube in one girder at least in approximate axial alignment with the sheathing tube in the other girder, bridging the space between the adjacent ends of the girders by the stiffening tubes axially displaced from one of the girders, placing formwork about the open space between the adjacent ends of the girders and enclosing the stiffening tubes extending between the girders, pouring concrete into the formwork and providing a continuation of the concrete between the adjacent ends of the girders, pushing the stiffening tubes within the formwork therefrom through the other one of the girders, extending a tendon continuously through the at least approximately aligned sheathing tubes and tensioning the tendon for effecting continuity through the series-aligned girders and the intermediate concrete section therebetween.

9. Method, as set forth in claim 7, including forming the tendon of individual sections each having an axial length which is a fractional part of the total axial length of the sheathing tube, and interconnecting the adjacent ends of adjacent sections of the tendons by means of a sleeve.

10. Method, as set forth in claim 9, including forming the sleeve of a material having a higher strength than the material forming the individual sections of the tendons.

11. Method, as set forth in claim 1, including axially displacing the smooth-walled tubes by pushing an axially extending steel bar from one end to the other through the sheathing tube and using the bar for pushing the smooth-walled tubes ahead of the bar out of the sheathing tube.

12. Method, as set forth in claim 11, using the steel bar as at least an axially extending part of the tendons.

13. Method, as set forth in claim 2, including centering the steel bar within the sheathing tubes by means of spacers positioned on the steel bar.

14. Method, as set forth in claim 11, including threading the outside surface of the steel bar.

15. Method, as set forth in claim 11, including hot rolling ribs on the outside surface of the steel bar and forming the ribs as partial threads.

* * * * *